United States Patent [19]

Allgaier

[11] 4,066,840

[45] Jan. 3, 1978

[54] STRIP SUPPLY LEAD WITH BRANCH LEADS AND METHOD OF MAKING SAME

[75] Inventor: Werner M. Allgaier, Germany

[73] Assignee: Raychem GmbH, Putzbrunn, Germany

[21] Appl. No.: 590,807

[22] Filed: June 27, 1975

[30] Foreign Application Priority Data

June 28, 1974 Germany ..... 7422135[U]
Aug. 13, 1974 Germany ..... 2438878

[51] Int. Cl.[2] ..... H01B 7/08

[52] U.S. Cl. ..... 174/72 R; 29/630 R; 339/176 MF

[58] Field of Search ..... 174/71 R, 72 R, 72 A, 174/72 TR, 117 F, 117 FF; 339/17 B, 17 F, 176 MF; 29/624, 628, 629, 630 R; 156/50

[56] References Cited

U.S. PATENT DOCUMENTS

| | | | |
|---|---|---|---|
| 3,069,753 | 12/1962 | Lalmond et al. | 339/176 MF X |
| 3,278,887 | 10/1966 | Travis | 339/176 MF |
| 3,696,319 | 10/1972 | Olsson | 339/176 MF X |

*Primary Examiner*—Laramie E. Askin
*Attorney, Agent, or Firm*—Lyon & Lyon

[57] ABSTRACT

Strip supply lead comprising a plurality of conductors embedded in a suitable insulating material (typically, a plurality of generally flat conductor elements in a strip of suitable polymeric material) is provided with a branch lead by first removing a portion of the insulating material in a zone intermediate the ends of the strip supply lead to expose a length of at least one of the conductor elements. The strip supply lead is folded about the midpoint of the bared conductor into a generally "U" shaped configuration to bring the surfaces of the portions on the intact strip supply lead immediately adjacent either end of the bared length of conductor forming the extremities of the shank of the "U" into an opposing relationship. A film of thermoplastic or thermosetting material is disposed between the opposed surfaces of intact strip supply lead and heated above the softening or thermosetting point to cause these surfaces to adhere together thereby forming a generally "U" shaped branch lead in which the bared length of conductor provides the point for electrical contact.

17 Claims, 5 Drawing Figures

STRIP SUPPLY LEAD WITH BRANCH LEADS AND METHOD OF MAKING SAME

FIELD OF THE INVENTION

The invention relates to a strip supply lead comprising a plurality of juxtaposed electrical conductors embedded in a strip of electrical insulating material having at least one branch lead and the method by which it is made.

The invention is particularly concerned with strip supply leads incorporating conductors of flat cross-section.

BACKGROUND OF THE INVENTION

In the case of strip supply lead, heretofore the branch leads have also taken the form of strip leads. They are connected to the main lead by removing the insulation from the latter in the area where it is desired to locate the branch lead followed by electrically connecting the bared end of each conductor of the branch lead to a conductor of the main lead, by soldering or spotwelding for example, the branch thus formed then being recovered with insulating material. At the end of the branch lead, remote from the main strip supply lead, the conductors are bared as required so that electrical contact with them can be established.

The production of such a strip supply lead with branch leads is relatively expensive in that it is labor intensive on account of the several operations that have to be carried out. Since the connections between the conductors of the main lead and the conductors of the branch lead have to be made with care in order to prevent dissimilar contact resistances between the individual conductors or the possible occurrence of poor mutual contact, skilled labor has to be used for making these connections.

Accordingly, it is an object of the invention to improve strip supply leads of the initially described kind and having one or more branch leads so that they can be produced more economically and are particularly reliable in operation.

SUMMARY OF THE INVENTION

According to the present invention, strip supply lead comprising a plurality of conductors embedded in a strip of insulating material is provided with branch leads by removing a portion of the insulating material intermediate the ends to expose a length of at least one conductor element, folding the strip supply lead about the midpoint of the bared length of conductor into a generally "U" shaped configuration, thereby bringing the surfaces of portions of the intact strip supply lead adjacent the ends of the bared conductor forming the extremeties of the shanks of the "U" into an opposed relationship, and joining the opposed surfaces to form a generally "U" shaped branch lead in which the bared length of conductor provides the surface for electrical contact.

DETAILED DESCRIPTION OF THE INVENTION

Figures 1, 2, 3, 4, 5:
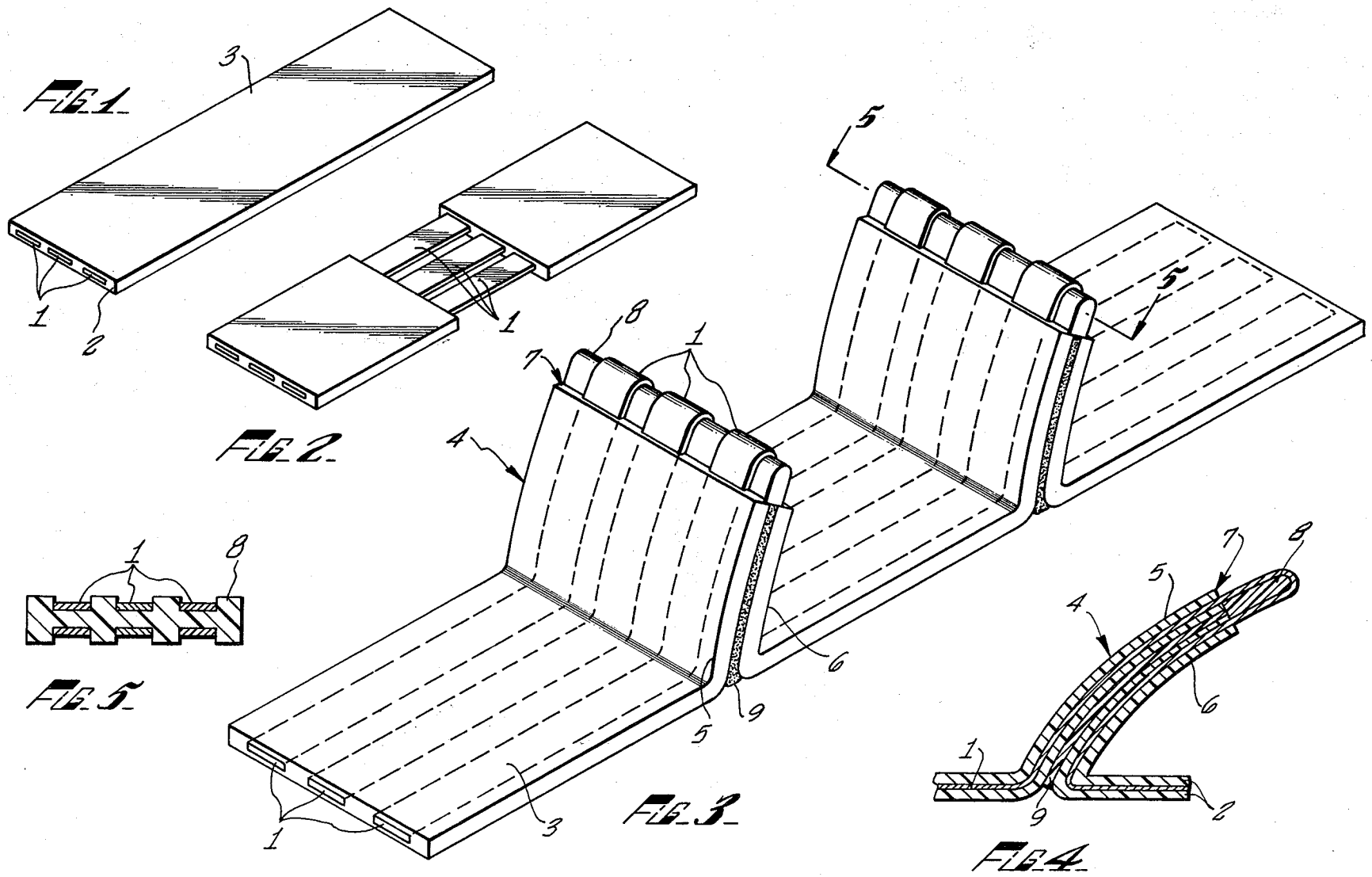
FIG. 1 is a perspective view of a length of strip supply lead.
FIG. 2 is a view in perspective of the strip supply lead of FIG. 1 having a portion of the insulating material removed.
FIG. 3 is a perspective view of a strip supply lead having two branch leads.
FIG. 4 is a vertical section through the strip supply lead of FIG. 1 in a plane through a branch lead.
FIG. 5 is a section through a strip supply lead on the line 5—5 of FIG. 3 and shows a modified form of insulating core.

According to the invention, in order to form the branch lead, a U-shaped loop with opposed shanks is formed in the strip supply lead, and at least one conductor is bared in the region of the exterior of the turn in the U-shaped loop for enabling a contact to be made.

The previously known method by which electrical connection of the conductors of the branch lead to the conductors of the main lead is therefore not necessary. Instead, the strip supply lead in accordance with the invention, inclusive of the branch leads, is made as a single part, the strip supply lead simply being doubled in the region of the branch leads. The conductors are bared at least on the outside at the outer turn of the U-shaped loop of the strip supply lead so that at this point the conductors of the main lead form the contact zone of the branch lead.

An adhesive film for causing portions of the shanks of the U-shaped loop having intact insulation to adhere to each other can be disposed between the shanks formed in the strip supply lead in the zone of the branch lead. If this film is made of a thermoplastic material, the portions of the strip of plastic material in the zone of the shanks can be bonded together by heating the branch lead to a temperature above the softening point of the film. Optionally, a film of thermosetting material can be used. The looped, uninterrupted ends of the conductors which are bared in the region of the turn of the U-shaped loop are thus relieved of mechanical load in an effective manner.

In a preferred form of the strip supply lead, the insulating material, typically an organic polymeric material, is completely removed in the region of the turn of the U-shaped loop, and in this region the conductors extend around an inserted insulating core of U-shaped cross-section. Thus, a very mechanically stable arrangement of the conductors of the branch lead that are to provide contact is achieved, this arrangement being in the form of the male part of a plug-and-socket connection, in which part the conductors, which are arranged side-by-side, are bared on both faces to enable them to make a contact. The male part of the plug-and-socket connection so produced can be easily inserted into a complementary female part of the connection.

By a suitable choice of the insulating material of which the strip is made, the portions of the strip forming the U-shaped loop can be bonded directly to each other in the region of the branch lead, so that the above-mentioned films become unnecessary. This form of the strip supply lead is particularly simple to produce. To form a branch lead, a U-shaped loop is simply formed in the strip supply lead in which the insulating material is, for example, a heat softenable thermoplastic material; the strip of insulating material is heated in the region of the U-shaped loop and thus becomes tacky and the portions thereof forming the loop become bonded to each other by pressing the surfaces together. The insulation provided by the thermoplastic material is then removed from the ends of the branch leads, for example by milling, so that the outer faces of the conductors are bared.

The strength of the union between the opposed surfaces of intact strip supply lead is a function of the manner by which the surfaces are joined, i.e., whether directly to one another or through the agency of a film disposed between the surfaces to bond them together. It is also a function of the area being joined. Accordingly, the length of opposed surfaces joined to each other and the manner of bonding is selected to provide a branch supply lead having a mechanical strength adequate to the intended use. The determination of these criteria can readily be determined by those skilled in the art.

The strip supply lead of the invention having branch leads is notable not only for the simple way in which it can be produced and its reliability in transmitting current to the ends of the branch leads, but in addition the branch leads can withstand heavy mechanical loads without the risk of any variation in contact resistance occurring, since the strip supply lead is formed as a single part. Contact resistance which occurs when the branch leads are soldered or otherwise connected to the main lead are eliminated. The branch leads can be of any required length and can be spaced from each other at any required distance.

The uses of the strip supply lead are limited only by the properties of the insulating material of which the strip is made and they thus range from the wiring of stationary circuits to applications in apparatus subjected to heavy mechanical loads such as prefabricated electronic units in vehicles, aircraft or space satellites.

The invention will now be discribed in greater detail and to provide advantageous particulars by reference to the drawings.

With reference to FIG. 1, three flat conductors 1, made of copper for example, are completely embedded in a strip 2 of insulating material, for example polyethylene or other suitable polymer, and are combined to form a strip supply lead 3. FIG. 2 shows the strip supply lead of FIG. 1 having a portion of the insulating material removed.

To form a branch lead, designated as a whole by the reference numeral 4 in FIG. 3, a generally U-shaped loop, the shanks 5 and 6 of which oppose each other, is formed in a zone intermediate of the ends of the strip supply lead. Insulating material is removed from the strip 3 in the region 7 of the turn of the U-shaped loop, so that conductors 1 extend out of the portion of the strip 3 forming one shank of the loop and then turn back into the portion of the strip forming the other shank of the loop. In this region 7 at the closed end of the U-shaped loop, the conductors 1 are passed round an insulating core 8 of suitable dielectric material having a U-shaped cross-section. Between the surfaces of the strip 3 insulating material forming the two shanks of the U constituting the branch lead 4 is fitted an adhesive film 9 which is made for example of thermoplastic material or thermosetting material and by which the two portions of the strip are joined to each other. The thickness of the insulating core 8 at the places where the portions of the lead strip bear against the core is preferably equal to the sum of the thickness of the film 9 and twice the thickness of the layer of insulating material between a conductor 1 and the exterior of the strip 3. It is also preferred that it have a rounded end to accommodate the fold of the conductors. This ensures that each conductor 1 contains no sharp bend where it passes out of the portion of strip 3 forming one shank 5 in the region of the turn of the U-shaped loop and runs back again into the portion of the plastic strip 3 forming the other shank 6.

As shown in FIG. 5, the insulating core 8 may have recesses formed therein in which the conductors 1 are accommodated, so that the conductors are firmly guided and mechanically protected. In their bared zones the conductors can be coated with a noble metal e.g. gold, so that they do not oxidize, in order to extend the service-life of their contact surfaces.

To form a branch lead 4 as illustrated in the drawings, a portion of the insulating material 2 of the strip 3 is first removed from the lead over a length corresponding to the length of that portion of each lead 1 that is to be bared in the region 7 of the turn of the U-shaped loop. This can be done in the customary manner, by milling for example. Thereafter, the U-shaped loop is formed in the strip supply lead; the film 9 of thermoplastic material is fitted between the two shanks of the U-shaped loop, and the insulating core 8, which may be formed integrally with the film 9, is fitted in the region of the bared conductors 1. The two shanks 5 and 6 of the U-shaped loop are pressed together and are heated to an extent depending upon the nature of the film 9 so that they adhere to each other. The contact end of the branch lead 4 comprising the conductors 1, which pass round the insulating core 8 and are bared on their surfaces, is very stable and itself forms the male part of a plug-and-socket connection.

It is also possible to form a branch lead merely by baring the conductors in a manner that exposes but one of their surfaces, in the zone where the branch lead is desired, to provide for electrical contact. The strip supply lead is then folded at about the midpoint of the bared zone into the desired U shaped configuration with the bared conductor surfaces disposed to the outside. The shanks of the U can be joined as hereinbefore described. In this way, the insulating core 8 can be eliminated where desired.

The present invention has been described in the form of presently preferred embodiments. It will be appreciated by those skilled in the art that variations from these embodiments can be made without departing from the scope of this invention.

I claim:

1. A method for providing strip supply lead, comprising a plurality of conductor elements embedded in an insulating material, with a branch lead comprising the steps in sequence:

A. removing a portion of the insulating material from each side of the strip supply lead in a zone intermediate the ends of the strip supply lead to completely bare a length of at least one conductor element;

B. folding the strip supply lead about the midpoint of the bared length of conductor element into a generally U-shaped configuration to bring the surfaces of portions of the intact strip supply lead immediately adjacent either end of the bared conductor element forming the extremities of the shanks of the U into an opposed relationship; and C. bonding the opposed surfaces of intact strip supply lead to each other to form a generally U-shaped branch lead in which the bared length of conductor element provides an electrical contact.

2. A method according to claim 1 wherein the step of removing a portion of the insulating material includes baring all the conductor elements in said zone intermediate the ends of the strip supply lead.

3. A method according to claim 2 wherein the step of bonding comprises bonding the opposed surfaces directly to each other by heating the insulating material on the opposed surfaces to render it tacky and pressing the surfaces together.

4. A method according to claim 2 wherein the step of bonding the opposed surfaces comprises joining the opposed surfaces by disposing an adhesive film between said surfaces.

5. A method according to claim 4 wherein the adhesive film is selected from the group consisting of thermoplastic film and thermosetting film.

6. A method for providing strip supply lead, comprising a plurality of conductor elements embedded in an insulating material, with a branch lead comprising the steps in sequence.

A. removing a portion of the insulating material in a zone intermediate the ends of the strip supply lead to bare a length of all the conductor elements;

B. folding the bared lengths of said conductor elements around an insulating core of generally U-shaped cross-section to bring the surfaces of portions of the intact strip supply lead immediately adjacent either end of the bared conductor elements forming the extremities of the shanks of the U into an opposed relationship; and C. bonding the opposed surfaces of intact strip supply lead to each other to form a generally U-shaped branch lead in which the bared lengths of conductor elements provide electrical contacts.

7. A method according to claim 6 wherein the insulating core has recesses receiving the bared lengths of conductor elements.

8. A method for providing strip supply lead, comprising a plurality of conductor elements embedded in an insulating material, with a branch lead comprising the steps in sequence:

A. removing a portion of the insulating material in a zone intermediate the ends of the strip supply lead to bare a length of all the conductor elements;

B. folding the bared lengths of said conductor elements about an insulating core of generally U-shaped cross-section to bring the surfaces of portions of the intact strip supply lead immediately adjacent either end of the bared conductor elements forming the extremities of the shanks of the U into an opposed relationship; and C. bonding the opposed surfaces of intact strip supply lead directly to each other by heating the insulating material on the opposed surfaces to render it tacky and pressing the surfaces together to form a generally U-shaped branch lead in which the bared lengths of conductor elements provide electrical contacts.

9. A method for providing strip supply lead, comprising a plurality of conductor elements embedded in an insulating material, with a branch lead comprising the steps in sequence:

A. removing a portion of the insulating material in a zone intermediate the ends of the strip supply lead to bare a length of all the conductor element;

B. folding the bared lengths of said conductor elements around an insulating core of generally U-shaped cross-section to bring the surfaces of portions of the intact strip supply lead immediately adjacent either end of the bared conductor elements forming the extremities of the shanks of the U into an opposed relationship; and C. bonding the opposed surfaces of intact strip supply lead to each other by disposing an adhesive film between said surfaces to form a generally U-shaped branch lead in which the bared lengths of conductor elements provide electrical contacts.

10. A strip supply lead comprising a plurality of conductor elements embedded in an insulating material and comprising a branch lead, said branch lead comprising a generally U-shaped bend in said strip supply lead about the midpoint of a length of conductor elements bared on each side in a zone intermediate the ends of the strip supply lead, the shanks of said U having at their extremities a portion of intact strip supply lead the opposed surfaces of which are bonded to each other.

11. A strip supply lead according to claim 10 wherein the opposed surfaces are bonded together by an adhesive film.

12. A strip supply lead according to claim 11 wherein the adhesive film is selected from the group consisting of thermoplastic film and thermosetting film.

13. A strip supply lead according to claim 10 wherein the opposed surfaces are bonded together by the insulating material of the strip supply lead.

14. A strip supply lead comprising a plurality of conductor elements embedded in an insulating material and comprising a branch lead, said branch lead comprising a generally U-shaped fold in said strip supply lead about the midpoint of a bared length of conductor elements in a zone intermediate the ends of the strip supply lead, the fold in the bared length of conductor elements having an insulating core of generally U-shaped cross-section inserted therein, the shanks of said U having at their extremities a portion of intact strip supply lead the opposed surfaces of which are bonded to each other.

15. A strip supply lead according to claim 14 wherein the insulating core has recesses receiving the bared lengths of conductor elements.

16. A strip supply lead comprising a plurality of conductor elements embedded in an insulating material and comprising a branch lead, said branch lead comprising a generally U-shaped fold in said strip supply lead about the midpoint of a bared length of conductor elements in a zone intermediate the ends of the strip supply lead, the fold in the bared length of conductor elements having an insulating core of generally U-shaped cross-section inserted therein, the shanks of said U having at their extremities a portion of intact strip supply lead the opposed surfaces of which are bonded to each other by an adhesive film.

17. A strip supply lead comprising a plurality of conductor elements embedded in an insulating material and comprising a branch lead, said branch lead comprising a generally U-shaped fold in said strip supply lead about the midpoint of a bared length of conductor elements in a zone intermediate the ends of the strip supply lead, the fold in the bared length of conductor elements having an insulating core of generally U-shaped cross-section inserted therein, the shanks of said U having at their extremities a portion of intact strip supply lead the opposed surfaces of which are bonded to each other by the insulating material of the strip supply lead.

* * * * *